US011075036B2

(12) United States Patent
Lindell et al.

(10) Patent No.: US 11,075,036 B2
(45) Date of Patent: Jul. 27, 2021

(54) MOTOR-DRIVEN VACUUM CIRCUIT BREAKER

(71) Applicant: ABB Schweiz AG, Baden (CH)

(72) Inventors: Elisabeth Lindell, Västerås (SE); Andrea Bianco, Sesto San Giovanni (IT); Andrea Ricci, Rome (IT); Lars Jonsson, Västerås (SE); Stefan Halén, Västerås (SE); Lars Liljestrand, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/641,547

(22) PCT Filed: Jun. 20, 2018

(86) PCT No.: PCT/EP2018/066336
§ 371 (c)(1),
(2) Date: Feb. 24, 2020

(87) PCT Pub. No.: WO2019/042618
PCT Pub. Date: Mar. 7, 2019

(65) Prior Publication Data

US 2020/0266008 A1 Aug. 20, 2020

(30) Foreign Application Priority Data

Aug. 29, 2017 (EP) ..... 17188313

(51) Int. Cl.
*H01H 3/26* (2006.01)
*H01H 11/00* (2006.01)

(52) U.S. Cl.
CPC ..... *H01H 3/26* (2013.01); *H01H 11/0062* (2013.01); *H01H 2003/266* (2013.01)

(58) Field of Classification Search
CPC . H01H 3/26; H01H 11/0062; H01H 2003/266
See application file for complete search history.

(56) References Cited

U.S. PATENT DOCUMENTS 6,373,015 B1 4/2002 Marchand et al.
9,837,229 B2 * 12/2017 Chaly ..... H01H 47/325
(Continued)

FOREIGN PATENT DOCUMENTS

CN 201503804 U 6/2010
CN 103336474 A 10/2013
(Continued)

OTHER PUBLICATIONS

International Preliminary Report on Patentability Application No. PCT/EP2018/066336 Completed: Nov. 28, 2019 17 Pages.
(Continued)

*Primary Examiner* — Adolf D Berhane
*Assistant Examiner* — Afework S Demisse
(74) *Attorney, Agent, or Firm* — Whitmyer IP Group LLC

(57) ABSTRACT

The present invention relates to a method for controlling a motor-driven vacuum circuit breaker. The method comprises initiate opening (S100) the circuit breaker, wherein the circuit breaker moves with an average opening speed of a contact pair of the circuit breaker, from a closed position to an open position of the circuit breaker, and decelerating (S110) the opening speed of the contact pair to below the average opening speed before the open position is reached to avoid overshoot, and initiate closing (S120) the circuit breaker, wherein the circuit breaker moves with an average closing speed of the contact pair, from the open position to the closed position, and decelerating (S130) the closing speed of the contact pair to below the average closing speed before contact touch at the closed position, wherein the circuit breaker moves with the decelerated speed at contact touch. A motor-driven vacuum circuit breaker, a computer program and a computer program product are also presented.

19 Claims, 6 Drawing Sheets

(56) References Cited

U.S. PATENT DOCUMENTS

| | | | | |
|---|---|---|---|---|
| 2006/0007623 | A1* | 1/2006 | Trivette | H01H 47/325<br>361/115 |
| 2007/0096682 | A1* | 5/2007 | Valdemarsson | H02P 1/18<br>318/772 |

FOREIGN PATENT DOCUMENTS

| | | | |
|---|---|---|---|
| EP | 2538429 | A1 | 12/2012 |
| GB | 2318913 | A | 5/1998 |
| WO | 2017016748 | A1 | 2/2017 |

OTHER PUBLICATIONS

International Search Report & Written Opinion of the International Searching Authority Application No. PCT/EP2018/066336 Completed: Aug. 9, 2018; dated Aug. 21, 2018 10 Pages.

* cited by examiner

MOTOR-DRIVEN VACUUM CIRCUIT BREAKER

TECHNICAL FIELD

The invention relates to a method for controlling a motor-driven vacuum circuit breaker, and a motor-driven vacuum circuit breaker thereof.

BACKGROUND

Vacuum circuit breakers are commonly used in medium voltage systems. In many applications the frequency of switching is low, but there exist some applications where the frequency of operation is extremely high, such as in arc furnaces. In arc furnaces circuit breakers can be switched up to 100 times per day.

CN 103336474 describes a vacuum circuit breaker permanent magnet mechanism.

SUMMARY

An object of the present invention is to enable increased lifetime of a circuit breaker.

According to a first aspect, there is presented a method for controlling a motor-driven vacuum circuit breaker. The method comprises initiate opening the circuit breaker, wherein the circuit breaker moves with an average opening speed of a contact pair of the circuit breaker, from a closed position to an open position of the circuit breaker, and decelerating the opening speed of the contact pair to below the average opening speed before the open position is reached to avoid overshoot, and initiate closing the circuit breaker, wherein the circuit breaker moves with an average closing speed of the contact pair, from the open position to the closed position, and decelerating the closing speed of the contact pair to below the average closing speed before contact touch at the closed position, wherein the circuit breaker moves with the decelerated speed at contact touch.

By opening and closing a circuit breaker with a motor in a controlled way, the lifetime of the circuit breaker is increased.

The deceleration during opening of the circuit breaker may be initiated after movement of more than half the distance between the contact pair in the open position, and deceleration during closing of the circuit breaker may be initiated after movement of more then half the distance between the contact pair in the open position.

The closing speed at contact touch may be reduced by 20-40% compared to the average closing speed.

The circuit breaker may comprise at least three contact pairs and three electrical motors, each electrical motor being controlled to open and close each contact pair individually.

The opening may be performed at a phase angle generating an arcing time long enough to avoid re-ignition, and closing may be performed at a phase angle generating low transient overvoltage or generating low inrush current.

The opening and closing of each contact pair may be synchronized with a phase angle of a voltage or current of a system that the circuit breaker is connected to. The opening may be performed at a phase angle of the system, preventing re-ignition. The closing may be performed at a phase angle of the system, targeting low transient overvoltage. The closing may alternatively be performed at a phase angle of the system, targeting low inrush currents.

According to a second aspect, there is presented a motor-driven vacuum circuit breaker. The circuit breaker comprises a controller and at least one contact pair, wherein the controller is configured to initiate open the contact pair, wherein the contact pair moves with an average opening speed, from a closed position to an open position of the circuit breaker, and to decelerate the opening speed of the contact pair to below the average opening speed before the open position is reached to avoid overshoot, and configured to initiate close the contact pair, wherein the contact pair moves with an average closing speed, from the open position to the closed position, and to decelerate the closing speed of the contact pair to below the average closing speed before contact touch at the closed position, wherein the contact pair moves with the decelerated speed at contact touch.

The controller may further be configured to initiate opening at a phase angle generating an arcing time long enough to avoid re-ignition, and to initiate closing at a phase angle generating low transient overvoltage or generating low inrush current.

The controller may comprise a processor and a computer program product storing instructions that, when executed by the processor, causes the controller to control the circuit breaker.

According to a third aspect, there is presented a computer program for controlling a circuit breaker having a controller and a contact pair. The computer program comprises computer program code which, when run on the controller, causes the controller to initiate open the contact pair, wherein the contact pair moves with an average opening speed, from a closed position to an open position of the circuit breaker, and decelerate the opening speed of the contact pair to below the average opening speed before the open position is reached to avoid overshoot, and to initiate close the contact pair, wherein the contact pair moves with an average closing speed, from the open position to the closed position, and decelerate the closing speed of the contact pair to below the average closing speed before contact touch at the closed position, wherein the contact pair moves with the decelerated speed at contact touch.

A computer program product is also presented. The computer program comprises a computer program and a computer readable storage means on which the computer program is stored is also presented.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

Figure 1:
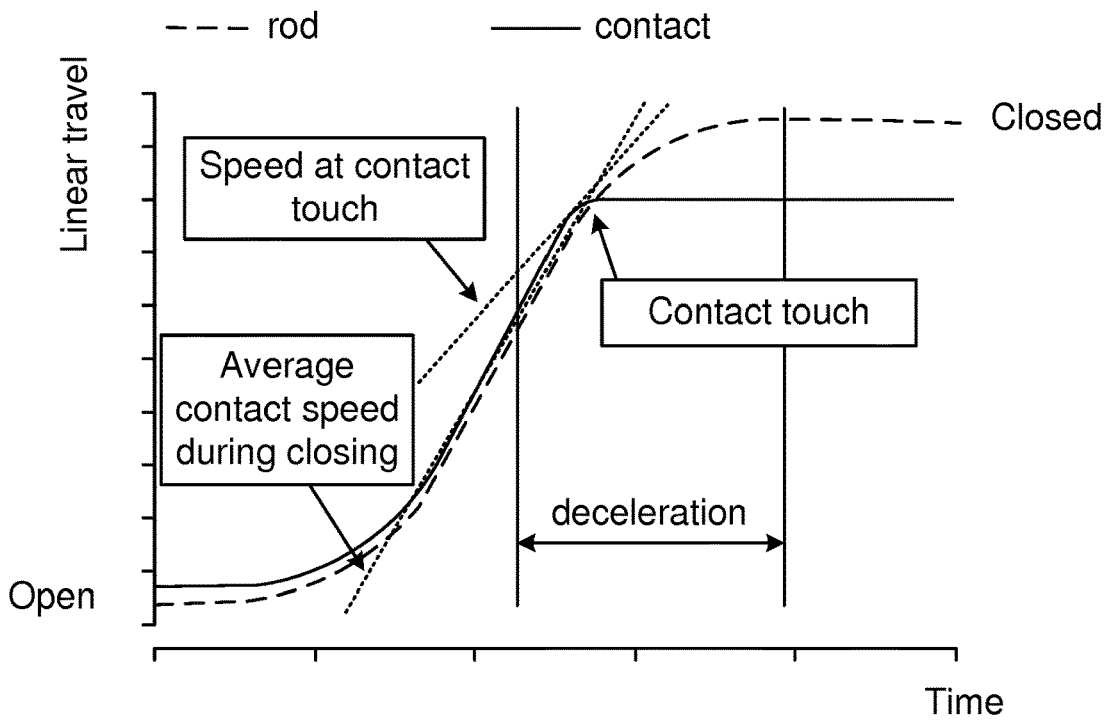
FIG. 1 schematically illustrates a travel curve for closing of a circuit breaker.

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

In the present invention, an electrical motor is utilized to in a precise way control the movement of a moveable vacuum circuit breaker contact. In this way, the motion of the movable contact can be controlled continuously from an open to a closed position of a contact pair of the circuit breaker, and vice versa. A so called travel curve is presented, which has been designed in order to minimize the mechanical, and to certain extent also the electrical, stress of the circuit breaker, and to thereby increase the lifetime of the circuit breaker. To a certain extent, a system in which the circuit breaker is implemented will also exhibit an increased lifetime.

The motor is an electrical motor, preferably a rotating, electrical motor. The axial position of a rotating electrical motor may e.g. be controlled by use of one or more sensors to indicate a linear position of the movable contact. Different positions of the movable contact may also be used to indirectly measure the linear speed thereof. The motion of the contact pair is described as being controlled continuously, but in reality detection of contact positions is made through sensors that detect discrete positions (although in practice perceived as continuously).

The contact pair of the circuit breaker may comprise a fixed contact and a movable contact or two movable contacts (i.e. the opening and closing speed of the travel curve is a relative speed between movable contacts or an absolute speed between a movable contact and a fixed contact). With two movable contacts, each being motor-driven, a higher acceleration/deceleration between the contacts can be achieved, but the circuit breaker will also require a bellow per contact. With one movable contact, being motor-driven, only one bellow is needed for the circuit breaker, but a lower acceleration/deceleration will be obtained with use of identical motor power. A contact pair with one movable contact and one fixed contact will be used in the following description.

The travel curve is designed for high average speed of the moveable contact during both the opening (or breaking) and the closing (or making) operation of the circuit breaker. A high average speed at opening is needed in order to maximize the interruption capability of the circuit breaker and to obtain a short arcing time. A high average speed at closing reduces the pre-arcing energy which decreases the electrical stress and which thereby increases the lifetime of the circuit breaker.

The travel curve is further designed to decelerate the moveable contact in a controlled way during closing to below the average closing speed before it reaches the fixed contact (contact touch). In this way the mechanical stress is reduced and the lifetime increased.

The travel curve is also designed to decelerate the moveable contact in a controlled way during opening to below the average opening speed before it reaches a normal open position. In this way the mechanical stress is reduced since overshoot (i.e. passing the desired end position of the movable contact) is minimized and the lifetime is increased.

Opening and closing of a circuit breaker may further be synchronized with phase voltage/current, to increase the lifetime of the circuit breaker and a system it is implemented in.

The presented invention allows for significantly increased number of operations, as compared to a standard circuit breaker solution. This is particularly useful when running plants such as arc furnaces where extremely high frequency of switching is used, up to 100 times per day, and the cost of maintaining/replacing a circuit breaker is high.

Figure 2:
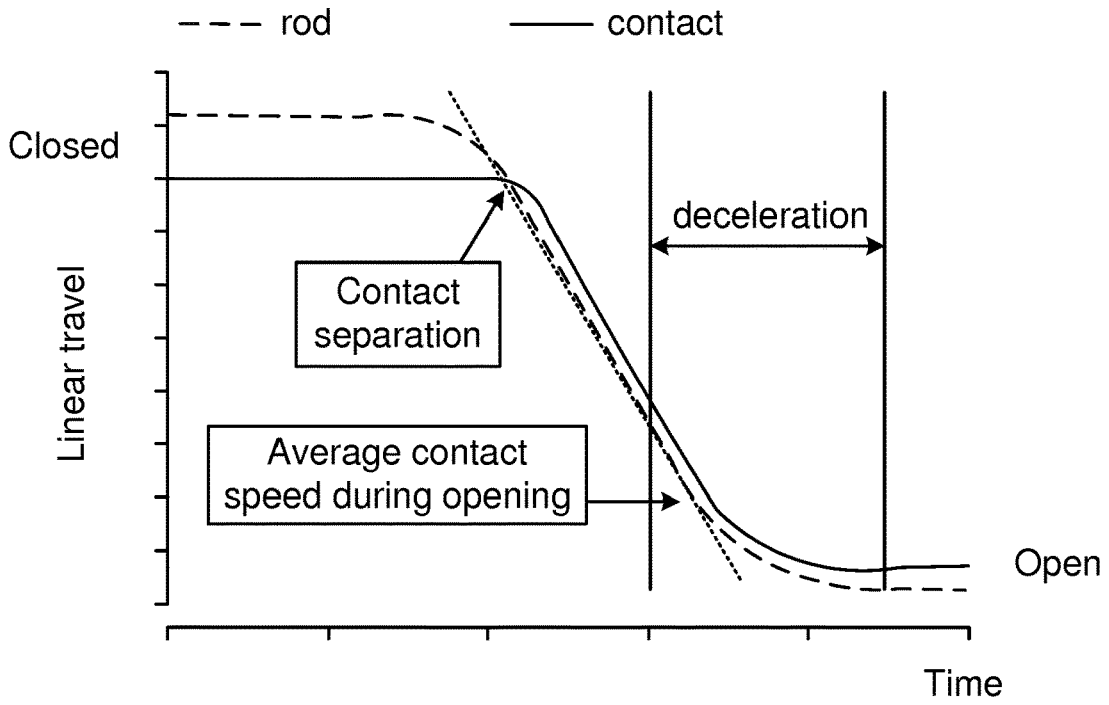
FIG. 2 schematically illustrates a travel curve for opening of a circuit breaker.

A closing travel curve is illustrated in FIG. 1, and an opening travel curve is illustrated in FIG. 2. The illustrated example is for a circuit breaker arranged in a medium voltage (MV) system. In a MV vacuum circuit breaker the distance between the contacts of a contact pairs may be about 10-25 mm in open position. The movable contact may have a rod comprising compression means (such as a compression spring) of about 4 mm compression distance, and the distance between the contact pairs may be about 16 mm in open position, which entails a total movement distance for the rod of about 20 mm. The travel curve of a rod having a compression means is illustrated in FIG. 1, wherein the travel curve for the rod is illustrated in a dashed line and the travel curve for a contact thereof is illustrated in a solid line. The dashed and solid lines are actually completely overlapping until contact touch, but drawn in parallel instead for illustrative purpose. Correspondingly, the travel curves of the rod and its contact are also drawn in parallel instead of overlapping for illustrative purpose.

The characteristics of the travel curve during closing are illustrated with an average speed of 1.3 m/s, marked in a dotted line, in this example. Decelerating of the speed before contact touch to about 0.8-1.0 m/s, illustrated in a dotted line for the derivate of the travel curve, is sufficient for the compression means to be able to absorb the rest of the traveling energy of the movable contact.

The characteristics of the travel curve at opening are illustrated with an average speed of 1.3 m/s, marked in a dotted line, in this example. Decelerating of the speed before reaching the open position is to avoid mechanical overshoot (i.e. passing the desired open position of the contact pair).

An aspect of vacuum circuit breakers is that if a number of conditions are fulfilled, such as system configuration of the system they are installed in and type of switching operation they perform, they may cause high transient overvoltage. There is however also a statistical phenomenon that depends on at which phase angle circuit breaker operations are performed. In case of very frequent switching, the likelihood of eventually hitting an unfavourable phase angle obviously grows. The controlled travel curve may be combined with synchronization to voltages/currents in the grid, to even further increase the lifetime of the circuit breaker and the lifetime of a system the circuit breaker is implemented in. The increased lifetime of the circuit breaker is due to less pre-arcing energy and shorter arcing time. Increased lifetime of the system is due to less transients (overvoltage and/or inrush current). Synchronization to grid voltages/currents may also solve issues of transient overvoltage in the system during both opening and closing. Synchronization can instead be utilized for further increasing the lifetime of the circuit breaker in combination with minimizing inrush currents in the system, if inrush currents are regarded as a more important issue than overvoltage.

The travel curves may thus be utilized in addition to synchronization of the opening and closing operations, respectively, to the phase angle of external voltages/currents.

Figure 3:
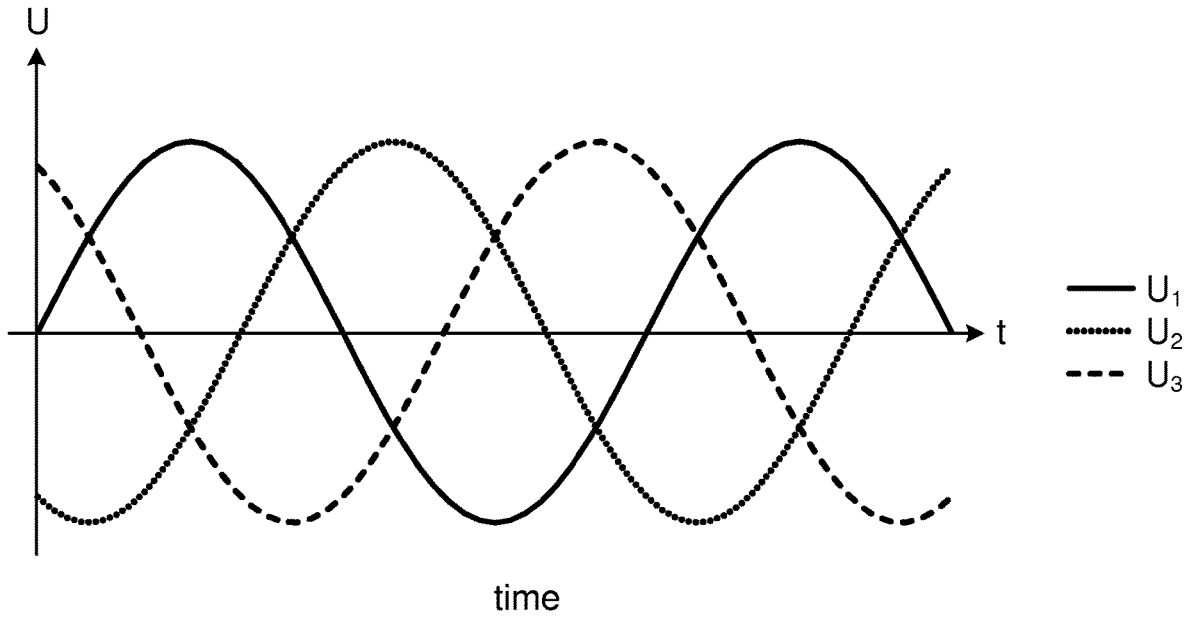
FIG. 3 schematically illustrates phase sequence in a three phase system.

For synchronisation, one motor is utilized for each circuit breaker contact pair, i.e. enabling single pole operation, i.e. independent synchronization to the voltage/current of each phase. Circuit breakers are often used in three-phase systems, and a phase sequence of a three-phase system is illustrated in FIG. 3.

The synchronization to the external voltages/currents may be performed in the following way:

1a) Closing is either performed at a phase angle targeting as low phase-to-ground voltage as possible in each phase, thereby minimizing the pre-arcing energy and increasing the electrical life of the circuit breaker further. This also minimizes the amplitude of the overvoltage at the making/closing operation.

1b) Alternatively, closing is performed at a phase-angle targeting as low generation of inrush currents as possible. This is the option to be utilized if inrush currents are regarded as a more important issue than overvoltage. The lifetime of the breaker will still be quite good as the optimal travel curve is utilized, but somewhat worse than if solution 1a is used regarding synchronization.

2) Opening is performed at a phase angle generating an arcing time long enough to avoid re-ignitions to occur. In this way, high transient overvoltage is prevented from occurring. The arcing time may be chosen as short as possible with respect to the occurrence of re-ignitions according to above, in order to minimize contact wear.

Overvoltage stresses caused by the circuit breaker in the system will be significantly reduced, implying that overvoltage protection devices can be removed or minimized, which saves cost and saves space, and issues with electromagnetic disturbances which can be adverse to production are removed.

For disconnection of an inductive load, i.e. a power factor (pf) of $0 \leq pf < 1$, in order to prevent high transient overvoltage, subsequent energizing may be performed in an optimal way, in order to also minimize inrush current.

Synchronization of opening and closing of the circuit breaker to grid voltages/currents can reduce transient overvoltage at opening of the circuit breaker and minimize inrush current at closing of the circuit breaker. This further limits stress on equipment connected to the system (such as transformers). With minimized inrush current the system in which the circuit breaker is implemented in reaches steady state more quickly. An aim is to keep the inrush current at a nominal load current or lower. Synchronization of opening and closing of the circuit breaker to grid voltages/currents can also reduce electric stress of the circuit breaker.

Figure 4:
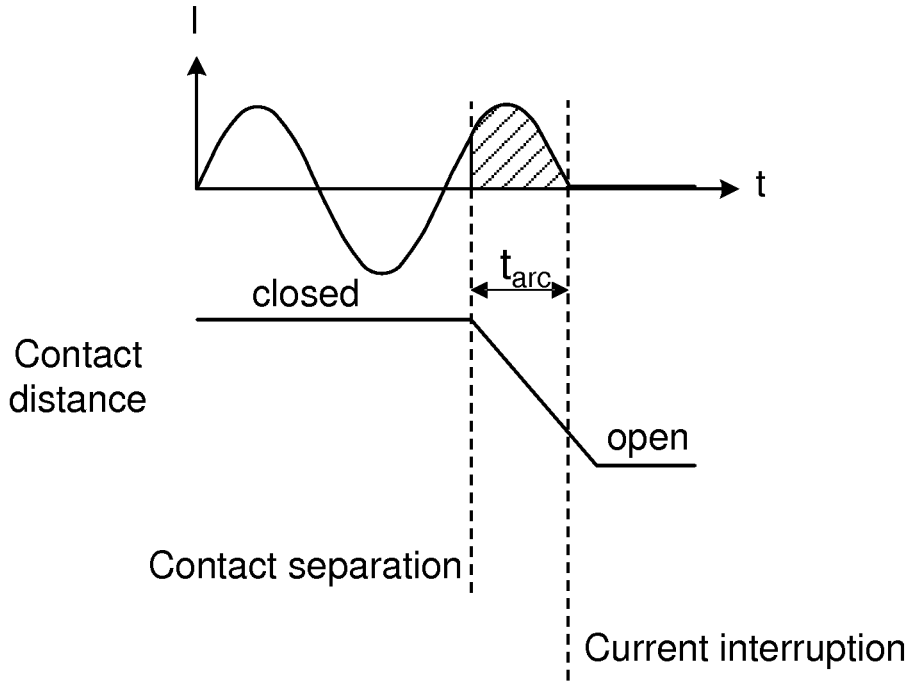
FIG. 4 schematically illustrates a long arcing time in a circuit breaker.
Figure 5:
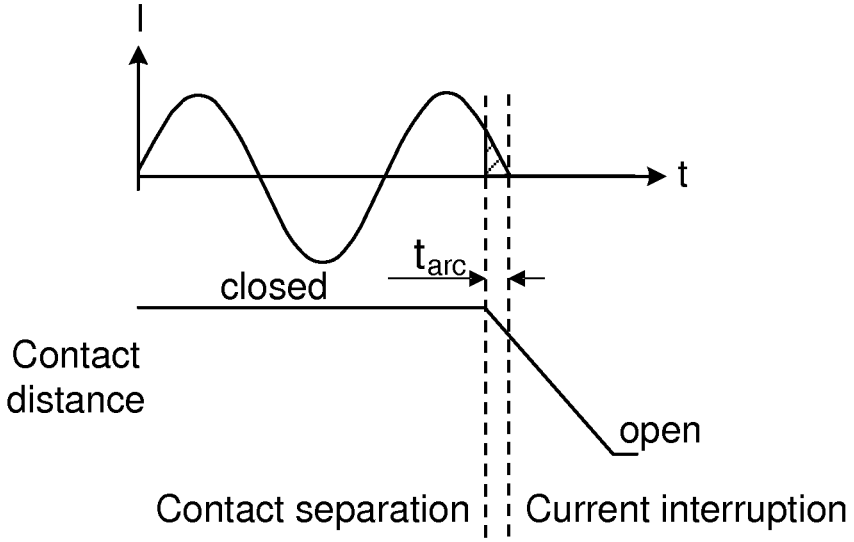
FIG. 5 schematically illustrates a short arcing time in a circuit breaker.

Opening of the circuit breaker will initially provide contact separation of the contact pair, which will ignite an arc if the current is above a current chopping level. If the current is below a current chopping level, the current will be interrupted immediately. An ignited arc will be interrupted thereafter at a current zero crossing or more precisely shortly prior to the current zero crossing in case current chopping occurs. Contact separation and current interruption is illustrated in FIGS. 4 and 5. In FIG. 4 a long arcing time is illustrated, which will provide a sufficient contact distance at current interruption preventing re-ignition. In FIG. 5 a short arcing time is illustrated, which will give a too short contact distance at current interruption, which will risk re-ignition. For synchronisation purposes, opening of a circuit breaker means contact separation.

Figure 6:
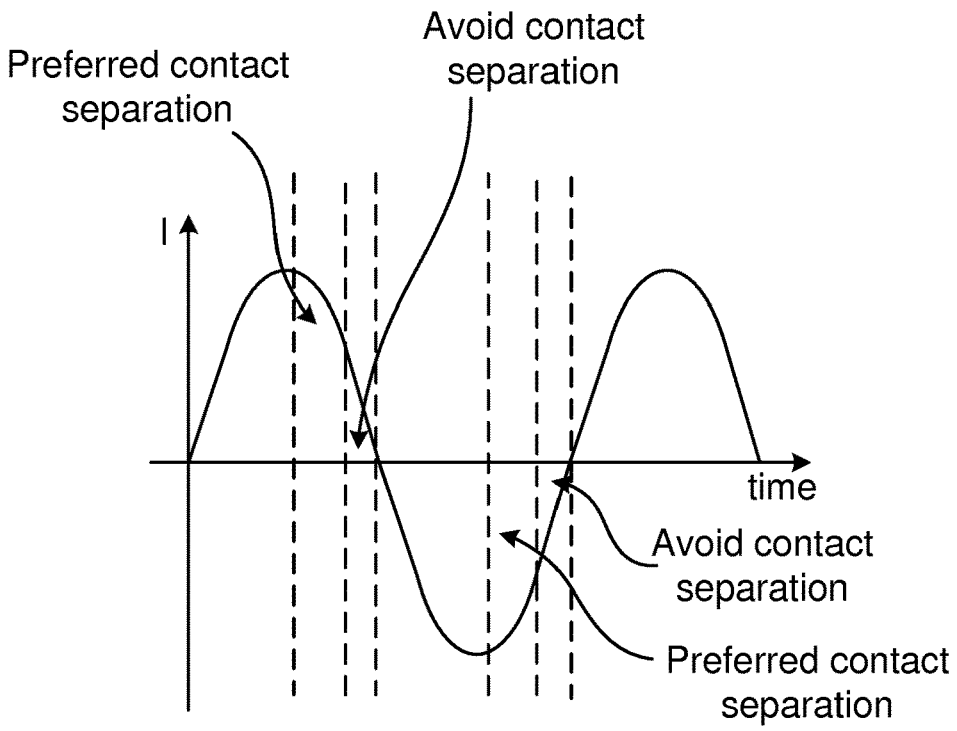
FIG. 6 schematically illustrates possible opening instances in a phase.

It is desirable to open the contact pair of a phase before a zero crossing of the current in the phase, to minimize overvoltage in the system. Opening of the phase should be initiated sufficiently long before the current interruption, such that the circuit breaker has had time to achieve sufficient contact separation before the current interruption. Contact separation is preferably achieved at least 1 ms before the current interruption for a 50 Hz system. To ensure that an arc does not reignite after the zero crossing, contact separation is more preferably made before the zero crossing with a security margin of either a quarter period i.e. 5 ms for a 50 Hz system or one sixth of a period i.e. 3.33 ms for a 50 Hz system. Possible opening instances are illustrated in FIG. 6.

Figure 7A:
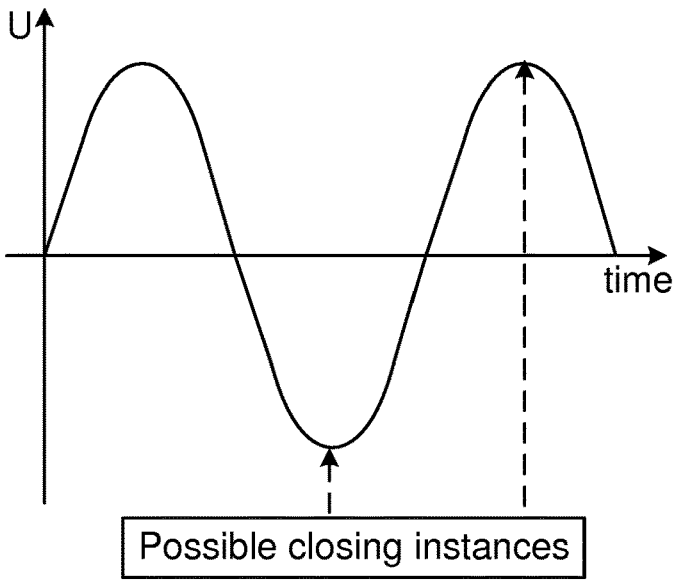
FIGS. 7*a* and 7*b* schematically illustrates possible closing instances for minimizing transient overvoltage and inrush current, respectively.
Figure 7B:
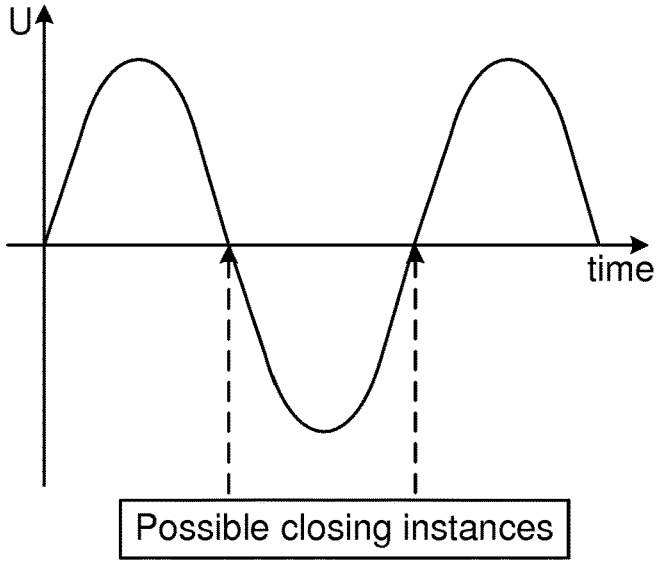

Possible closing instances of a circuit breaker are illustrated in FIG. 7*a*, in order to minimize transient overvoltage. Possible closing instances of a circuit breaker are illustrated in FIG. 7*b*, in order to minimize inrush currents.

Figure 8:
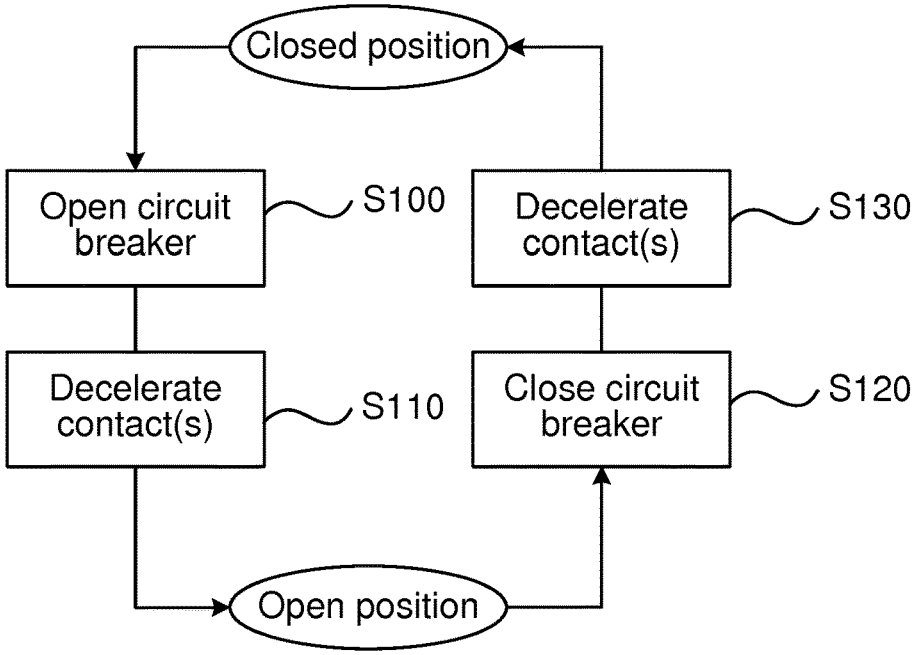
FIG. 8 is a flowchart illustrating a method for controlling a circuit breaker according a method presented herein.

A method for controlling a motor-driven vacuum circuit breaker is presented with reference to FIG. 8. The breaker is operated either from closed position to open position or from open position to closed position, and control of both making and breaking of the circuit breaker is needed. The method comprises, when breaking the circuit breaker, initiate opening S100 the circuit breaker. During the opening the circuit breaker moves with an average opening speed of a contact pair of the circuit breaker, from a closed position to an open position of the circuit breaker. The method thereafter comprises, when breaking the circuit breaker, decelerating Silo the opening speed of the contact pair to below the average opening speed before the open position is reached to avoid overshoot. The method further comprises, when making the circuit breaker, initiate closing S120 the circuit breaker. During the closing the circuit breaker moves with an average closing speed of the contact pair, from the open position to the closed position. The method thereafter comprises, when making the circuit breaker, decelerating S130 the closing speed of the contact pair to below the average closing speed before contact touch at the closed position, wherein the circuit breaker moves with the decelerated speed at contact touch.

When the opening of the circuit breaker is initiated, the speed with which the contact pair separates is quickly accelerated up to a desired opening speed. The average speed between the closed position and the open position is called the average opening speed. If the closing speed has been constant during closing, any deceleration will reduce the speed below the average opening speed, but if the closing speed has not been completely constant during closing, deceleration to below the average opening speed will require a certain amount of reduced opening speed, which amount easily can be obtained by trial and error for each configuration of a circuit breaker. The closing speed is thus reduced below the average opening speed at contact touch.

The deceleration may during opening of the circuit breaker be initiated after movement of more than half the distance between the contact pair in the open position, and deceleration may during closing of the circuit breaker be initiated after movement of more than half the distance between the contact pair in the open position.

The closing speed may at contact touch be reduced by 20-40% compared to the average closing speed.

The circuit breaker may comprise at least three contact pairs and three electrical motors, each electrical motor being controlled to open and close each contact pair individually.

The opening may be performed at a phase angle generating an arcing time long enough to avoid re-ignition, and closing may be performed at a phase angle generating low transient overvoltage or generating low inrush current.

The opening and closing of each contact pair may be synchronized with a phase angle of a voltage or current of a system that the circuit breaker is connected to. The opening may be performed at a phase angle of the system, preventing re-ignition. The closing may be performed at a phase angle of the system, targeting low transient overvoltage. Alternatively, the closing may be performed at a phase angle of the system, targeting low inrush currents.

Figure 9:
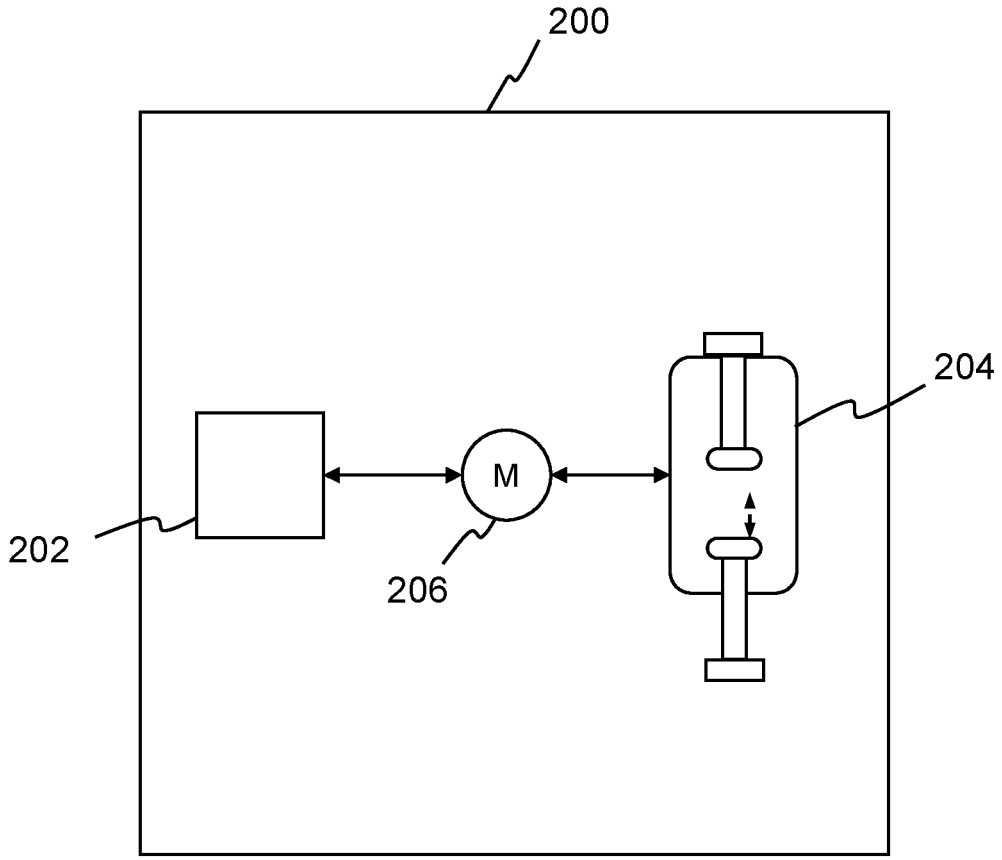
FIG. 9 is a schematic diagram illustrating a circuit breaker according to the present teachings.

A motor-driven vacuum circuit breaker 200 is presented in FIG. 9. The circuit breaker 200 comprises a controller 202, motor 206, and at least one contact pair 204, wherein the controller is configured to initiate open S100 the contact pair, wherein the contact pair moves with an average opening speed, from a closed position to an open position of the circuit breaker, and decelerate Silo the opening speed of the contact pair to below the average opening speed before the open position is reached to avoid overshoot, when breaking the circuit breaker. The controller is further configured to initiate close S120 the contact pair, wherein the contact pair moves with an average closing speed, from the open position to the closed position, and decelerate S130 the closing speed of the contact pair to below the average closing speed before contact touch at the closed position, wherein the contact pair moves with the decelerated speed at contact touch, when making the circuit breaker.

The controller may further be configured to initiate opening at a phase angle generating an arcing time long enough to avoid re-ignition, and to initiate closing at a phase angle generating low transient overvoltage or generating low inrush current.

The controller may comprise a processor and a computer program product storing instructions that, when executed by the processor, causes the controller to control the circuit breaker.

The circuit breaker controller may comprise a processor, using any combination of one or more of a suitable central processing unit, CPU, multiprocessor, microcontroller, digital signal processor, DSP, application specific integrated circuit etc., capable of executing software instructions of a computer program stored in a memory. The memory can thus be considered to be or form part of a computer program product. The processor may be configured to execute a computer program stored therein to cause the circuit breaker controller to perform desired steps.

A computer program for controlling a circuit breaker having a controller and a contact pair is presented. The computer program comprises computer program code which, when run on the controller, causes the controller to initiate open S100 the contact pair, wherein the contact pair moves with an average opening speed, from a closed position to an open position of the circuit breaker, and decelerate Silo the opening speed of the contact pair to below the average opening speed before the open position is reached to avoid overshoot, when breaking the circuit breaker, and to initiate close S120 the contact pair, wherein the contact pair moves with an average closing speed, from the open position to the closed position, and decelerate S130 the closing speed of the contact pair to below the average closing speed before contact touch at the closed position, wherein the contact pair moves with the decelerated speed at contact touch, when making the circuit breaker.

A computer program product is also presented. The computer program product comprises a computer program and a computer readable storage means on which the computer program is stored.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method for controlling a motor-driven vacuum circuit breaker, the method being performed in a motor-driven vacuum circuit breaker and comprising:

initiate opening the circuit breaker, wherein a motor-driven contact pair of the circuit breaker during opening moves along a travel curve with an average opening speed from a closed position to an open position of the circuit breaker, and decelerating, during the opening of the circuit breaker, an opening speed of the contact pair to below the average opening speed before the open position is reached to minimize overshoot; and initiate closing the circuit breaker, wherein the motor-driven contact pair of the circuit breaker during closing moves along a travel curve with an average closing speed from the open position to the closed position, and decelerating, during the closing of the circuit breaker, a closing speed of the contact pair to below the average closing speed before contact touch at the closed position, wherein the closing speed at contact touch is reduced by 20-40% compared to the average closing speed.

2. The method as claimed in claim 1, wherein:

the deceleration during opening of the circuit breaker is initiated after movement of more than half the distance between the contact pair in the open position; and the deceleration during closing of the circuit breaker is initiated after movement of more then half the distance between the contact pair in the open position.

3. The method as claimed in claim 2, wherein the circuit breaker comprises at least three contact pairs and three electrical motors, each electrical motor being controlled to open and close each contact pair individually.

4. The method as claimed in claim 2, wherein the opening is performed at a phase angle generating an arcing time long enough to avoid re-ignition, and closing is performed at a phase generating low transient overvoltage or generating low inrush current.

5. The method as claimed in claim 2, wherein the opening and closing of each contact pair is synchronized with a phase angle of a voltage or current of a system that the circuit breaker is connected to.

6. The method as claimed in claim 1, wherein the circuit breaker comprises at least three contact pairs and three electrical motors, each electrical motor being controlled to open and close each contact pair individually.

7. The method as claimed in claim 1, wherein the opening is performed at a phase angle generating an arcing time long enough to avoid re-ignition, and closing is performed at a phase generating low transient overvoltage or generating low inrush current.

8. The method as claimed in claim 1, wherein the opening and closing of each contact pair is synchronized with a phase angle of a voltage or current of a system that the circuit breaker is connected to.

9. The method as claimed in claim 8, wherein the opening is performed at a phase angle of the system, preventing re-ignition.

10. The method as claimed in claim 9, wherein the closing is performed at a phase angle of the system, targeting low transient overvoltage.

11. The method as claimed in claim 8, wherein the closing is performed at a phase angle of the system, targeting low transient overvoltage.

12. The method as claimed in claim 8, wherein the closing is performed at a phase angle of the system, targeting low inrush currents.

13. A motor-driven vacuum circuit breaker, the circuit breaker comprising a controller and at least one motor-driven contact pair, wherein:

the controller is configured to initiate open the contact pair, wherein the contact pair during opening moves along a travel curve with an average opening speed, from a closed position to an open position of the circuit breaker, and decelerate, during the opening of the circuit breaker, an opening speed of the contact pair to below the average opening speed before the open position is reached to minimize overshoot, and configured to initiate close the contact pair, wherein the contact pair during closing moves along a travel curve with an average closing speed, from the open position to the closed position, and decelerate, during the closing of the circuit breaker, a closing speed of the contact pair to below the average closing speed before contact touch at the closed position, wherein the contact pair moves with the closing speed at contact touch is reduced by 20-40% compared to the average closing speed.

14. The circuit breaker as claimed in claim 13, wherein the controller further is configured to initiate opening at a phase angle generating an arcing time long enough to avoid re-ignition, and to initiate closing at a phase angle generating low transient overvoltage or generating low inrush current.

15. The circuit breaker as claimed in claim 14, wherein the controller comprises a processor and a computer program product storing instructions that, when executed by the processor, causes the controller to control the circuit breaker.

16. The circuit breaker as claimed in claim 13, wherein the controller comprises a processor and a computer program product storing instructions that, when executed by the processor, causes the controller to control the circuit breaker.

17. A computer program for controlling a circuit breaker having a controller and a motor-driven contact pair, the computer program comprising computer program code which, when run on the controller, causes the controller to:

initiate open the contact pair, wherein the contact pair during opening moves along a travel curve with an average opening speed, from a closed position to an open position of the circuit breaker, and decelerate during the opening of the circuit breaker, an opening speed of the contact pair to below the average opening speed before the open position is reached to minimize overshoot, and to initiate close the contact pair, wherein the contact pair during closing moves along a travel curve with an average closing speed, from the open position to the closed position, and decelerate, during the closing of the circuit breaker, a closing speed of the contact pair to below the average closing speed before contact touch at the closed position, wherein the contact pair moves with the closing speed at contact touch is reduced by 20-40% compared to the average closing speed.

18. The computer program as claimed in claim 17, wherein the controller further is caused to open and close each contact pair synchronized with a phase angle of a voltage or current of a system that the circuit breaker is connected to.

19. A computer program product comprising a computer program and a computer readable storage means on which the computer program is stored for controlling a circuit breaker having a controller and a motor-driven contact pair, the computer program comprising computer program code which, when run on the controller, causes the controller to:

initiate open the contact pair, wherein the contact pair during opening moves along a travel curve with an average opening speed, from a closed position to an open position of the circuit breaker, and decelerate, during the opening of the circuit breaker, an opening speed of the contact pair to below the average opening speed before the open position is reached to minimize overshoot, and to initiate close the contact pair, wherein the contact pair during closing moves along a travel curve with an average closing speed, from the open position to the closed position, and decelerate, during the closing of the circuit break, a closing speed of the contact pair to below the average closing speed before contact touch at the closed position, wherein the contact pair moves with the closing speed at contact touch is reduced by 20-40% compared to the average closing speed.

* * * * *